United States Patent [19]

Wethington et al.

[11] 3,939,030

[45] Feb. 17, 1976

[54] CARPET MACHINE

[75] Inventors: Charles A. Wethington; David G. Littlejohn, both of Spartanburg, S.C.

[73] Assignee: Deering Milliken Research Corporation, Spartanburg, S.C.

[22] Filed: July 8, 1974

[21] Appl. No.: 486,518

Related U.S. Application Data

[63] Continuation of Ser. No. 309,489, Nov. 24, 1972, abandoned.

[52] U.S. Cl. ..... 156/435; 156/462

[51] Int. Cl.[2] ..... D04H 13/00; D05C 15/00

[58] Field of Search ..... 156/72, 162, 173, 177, 156/179, 189, 204, 205, 210, 429, 430, 431, 435, 443, 446, 459, 462, 468, 472, 473, 474, 475, 477, 489, 490, 491; 28/1.8, 72 P; 161/62, 63, 66, 67; 112/79 R, 79 A

[56] References Cited

UNITED STATES PATENTS

| | | | |
|---|---|---|---|
| 2,116,048 | 5/1938 | Smith | 156/435 |
| 2,583,337 | 1/1952 | Laing | 156/435 |
| 2,638,959 | 5/1953 | Johnson | 161/63 |
| 2,831,525 | 4/1958 | Cole | 156/435 |
| 2,912,945 | 11/1959 | Nowicki | 161/63 |
| 3,132,985 | 5/1964 | Moore | 156/462 |
| 3,157,554 | 11/1964 | Beasley | 156/435 |
| 3,309,252 | 3/1967 | Adler | 156/435 |

FOREIGN PATENTS OR APPLICATIONS

| | | | |
|---|---|---|---|
| 1,560,873 | 10/1969 | Germany | 156/435 |

*Primary Examiner*—Douglas J. Drummond
*Assistant Examiner*—John E. Kittle
*Attorney, Agent, or Firm*—Earle R. Marden; H. William Petry

[57] ABSTRACT

Method and apparatus to produce a bonded loop pile carpet. The carpet machine is of the rotary type which uses cooperating notched blade members which are shogged to form the yarn loops for bonding to a backing sheet. One set of the blade members is reciprocably mounted in the rotor of the machine.

5 Claims, 17 Drawing Figures

CARPET MACHINE

This is a continuation of application Ser. No. 309,489, filed Nov. 24, 1972, now abandoned.

It is an object of this invention to provide a method and apparatus to efficiently, inexpensively and continuously produce a bonded loop pile carpet.

Other objects and advantages of the invention will become readily apparent as the specification proceeds to describe the invention with reference to the accompanying drawings, in which.

Figure 1:
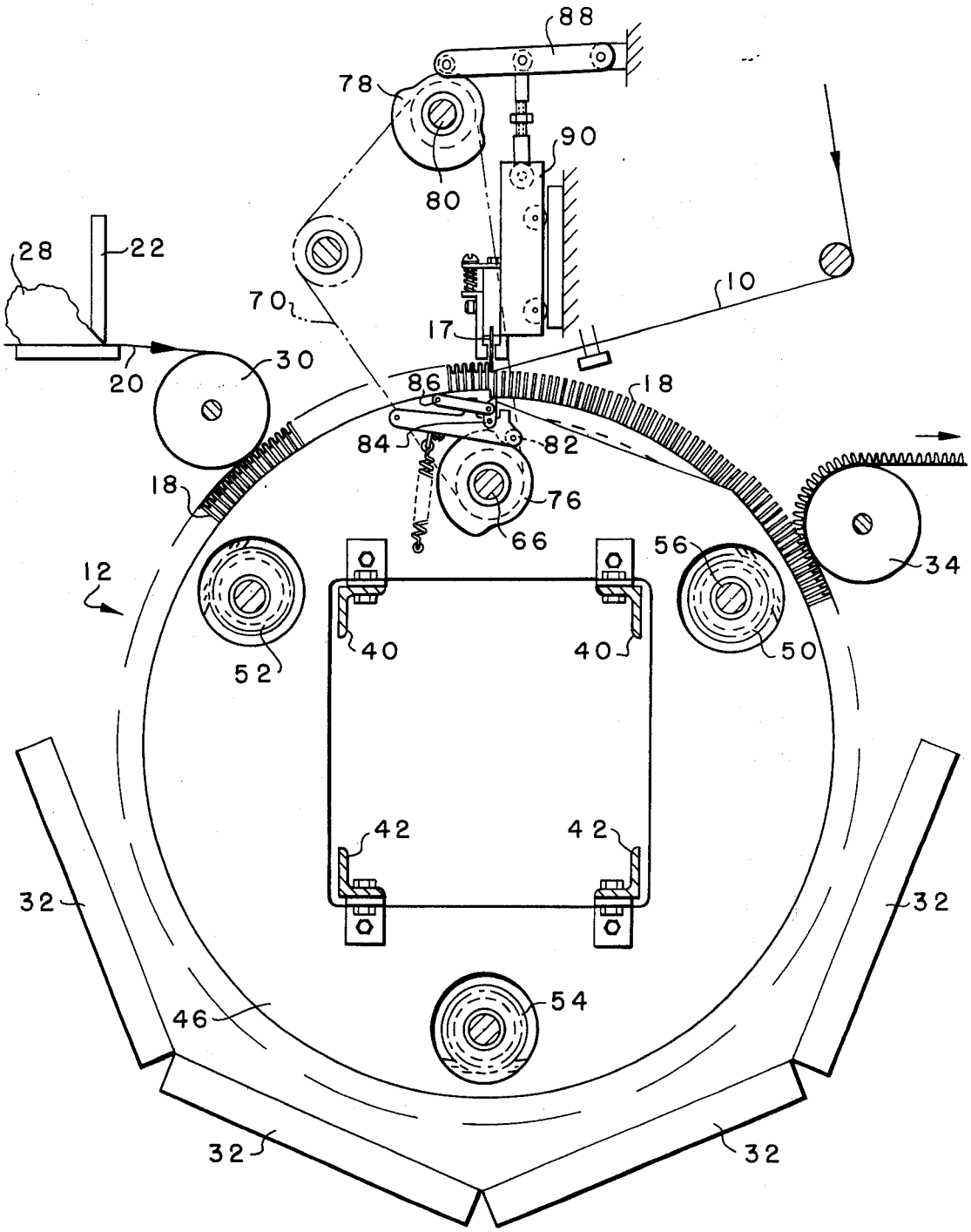
FIG. 1 is a sectional elevation view taken on line 1—1 of FIG. 2.
Figure 2:
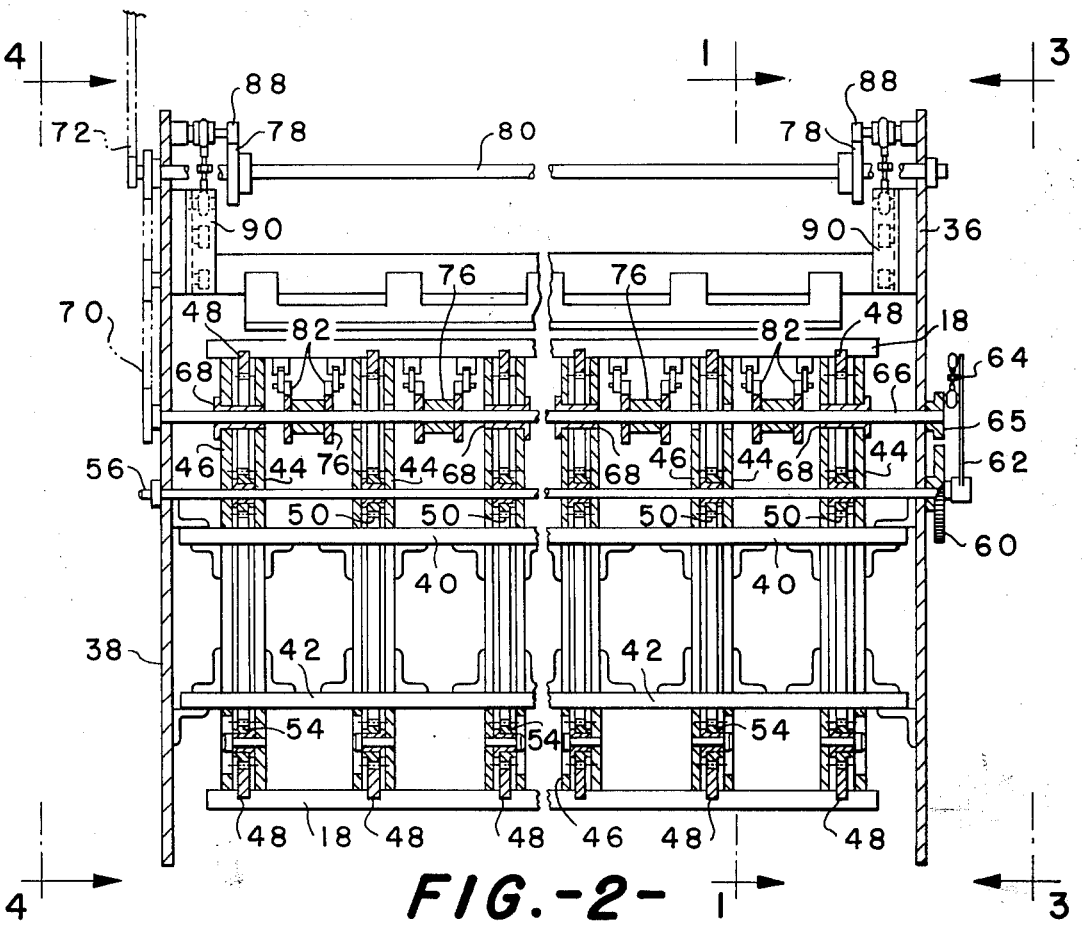
FIG. 2 is a cross-sectional elevation view of the carpet machine rotor.
Figure 8:
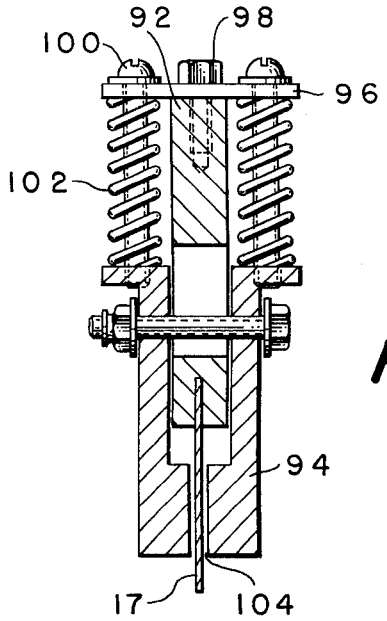
FIG. 8 is a blown-up view of the pressure foot shown in FIG. 6.
Figure 3:
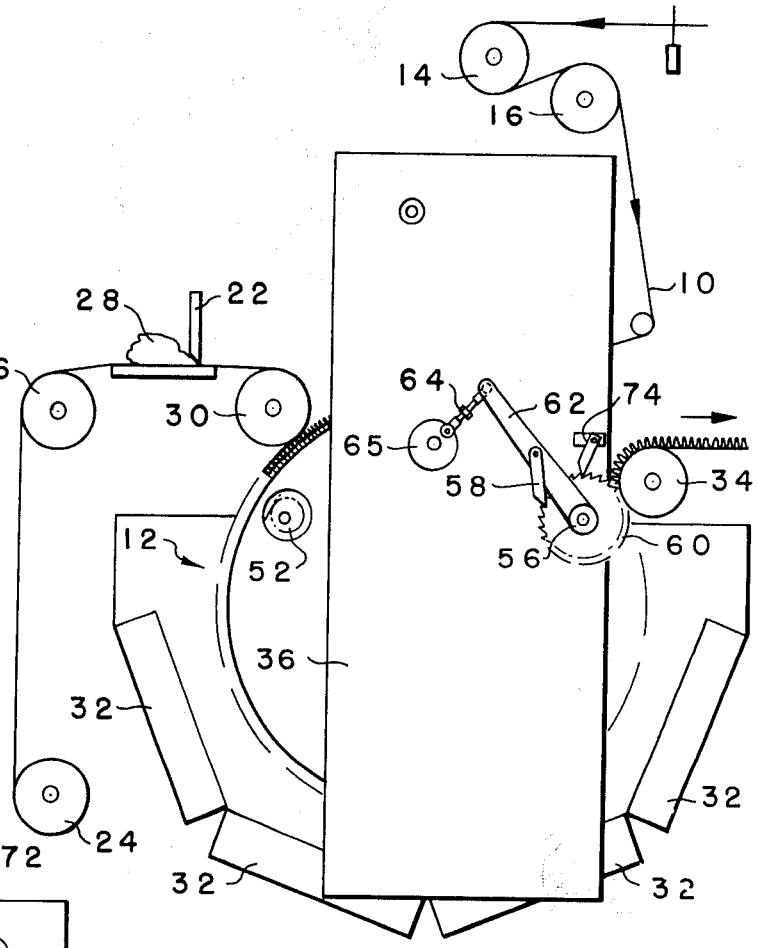
FIG. 3 is an elevation view taken on line 3—3 of FIG. 2.
Figure 4:
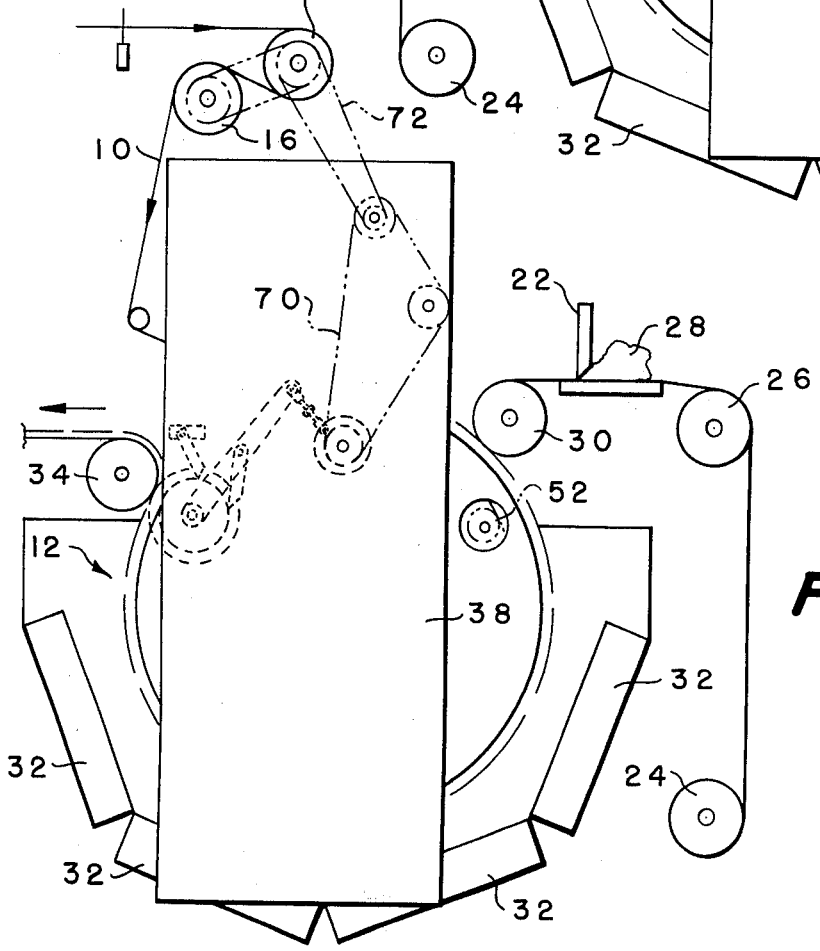
FIG. 4 is an elevation view taken on line 4—4 of FIG. 2.

Looking at FIGS. 1, 3 and 4, the overall concept will be explained. A plurality of yarn ends 10 are supplied from a warp beam or creel (not shown) to the rotor 12 over a pair of rolls 14 and 16. At the rotor, upper blade 17 cooperates with the lower blades 18 to insert the yarn in loops between the lower blades 18. The rotor is rotated counterclockwise and the loops are inserted into a suitable adhesive, such as polyvinyl chloride, placed on a backing sheet 20 by the doctor blade 22. The backing sheet is supplied from a roll 24, over a roll 26 to the adhesive station 28 and then over pressure roll 30 to a position against the top of loops. The backing sheet with the loops thereattached continues to rotate counterclockwise past the infrared electric heaters 32 to set the bond between the loops and the backing sheet. The bonded carpet is then doffed over roll 34 and delivered to the take-up roll (not shown).

The rotor 12 is supported between side plates 36 and 38 by cross-supports 40 and 42 to which are attached a plurality of support plates 44 and 46. Rotably supported between the plates 44 and 46 are blade support rings 48 which are held in position by drive gear 50 and idler gears 52 and 54 which are mounted on one of the plates 44 and 46 and engage the toothed inner surface of the rings 48. Each of the blade support rings 48 has a plurality of notches cut in the outer surface thereof to slidably support the lower blades 18. The lower blades are held in the notches by suitable means such as springs (not shown).

The driven gears 50 are rigidly secured to a rotably mounted shaft 56 which is intermittently rotated by the action of the pawl 58 against the ratchet 60 mounted on one end of shaft 56. The pawl 58 is pivotally mounted and actuated by the crank arm 62 which is rotated by the lever 64 connected to the crank 65.

Crank 65 is mounted on shaft 66 supported by bearings 68 in the plates 44 and 46 and is driven by chain 70 which is driven from a drive source (not shown) by chain 72. A second pawl 74 is pivotally mounted adjacent the ratchet 60 to prevent back lash of the ratchet.

Also mounted on the shaft 66 between adjacent pairs of plates 44, 46 are cams 76 to periodically actuate the blades 18. Another set of cams 78 is mounted on shaft 80 which is also driven by chain 70 in timed relation so that the cams 76 and 78 rotate in a one-to-one ratio.

Each of the cams 76 have a pair of spring loaded followers 82 operably associated therewith to slide upwardly one of the lower blades 18 at a predetermined time. The follower causes the pivotally mounted arm 84 to move upwardly to engage the blade 18. Another lever 86 is pivotally connected to cause the arm 84 to move in a substantially perpendicular direction to raise the blade 18 straight up.

Cams 78 are operably associated with a follower arm 88 pivotally connected to the frame of the machine to raise and lower the upper blade holder 90. Mounted to the blade holder 90 is the upper blade support 92 and the presser foot 94. The blade support 92 is secured to the movable plate 96 by means of bolt 98. Bolts 100 project through plate 96 to support the pressure foot 94. Located between the plate 96 and the presser foot 94 around the bolts 100 are compression springs 102 for reasons hereinafter explained. The upper blade 17 is mounted on the end of blade support 92 and projects through the elongated opening 104 in the presser foot.

In the preferred embodiment the rotor 12 is stopped when the blades 17 and 18 are forming the loops and then the rotor is indexed to the next loop forming position but such motion is not mandatory. It is contemplated that the motion of the rotor could be continuous and the blade holder 90 could move therewith in a manner as shown in U.S. Pat. No. 3,385,747 wherein the motion of the top blade is synchronized with the motion of a rotor by having the angular velocity of the blade holder equal to the angular velocity of the rotor during a portion of the loop forming period.

Figure 6:
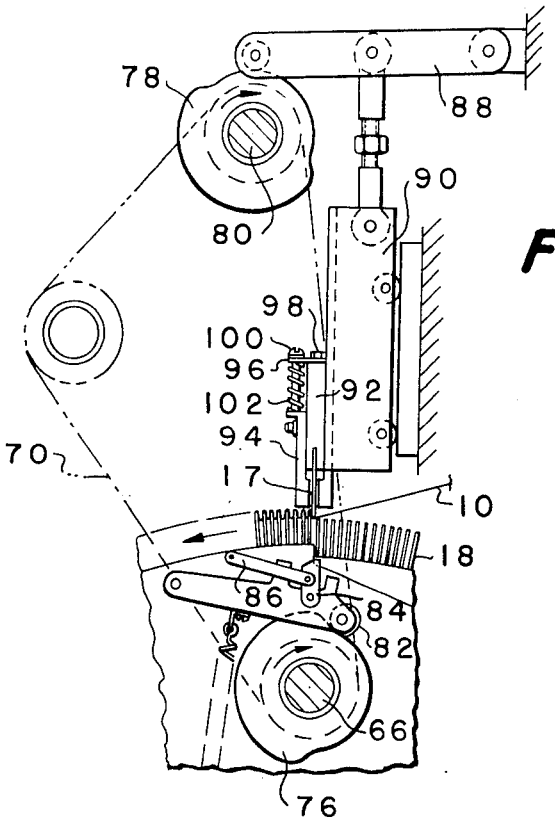
FIGS. 5–7 are blown-up views of the loop forming mechanism showing various stages of loop formation.
Figure 7:
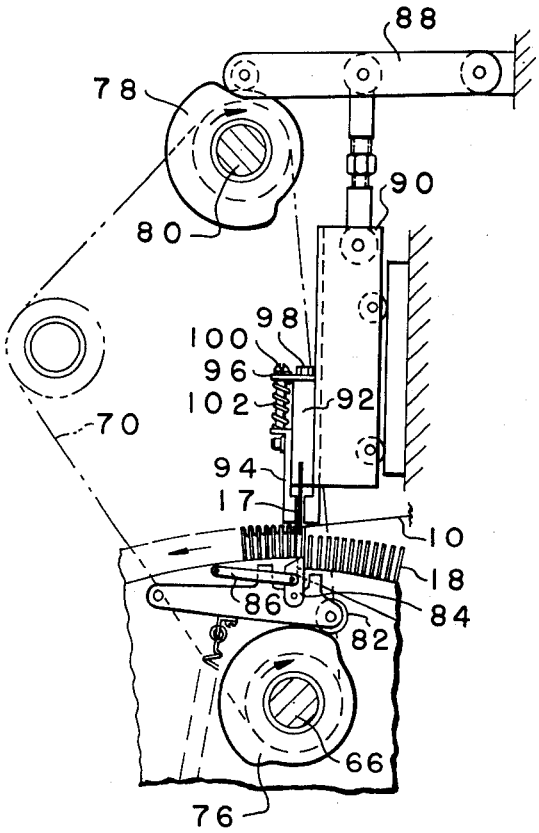
Figure 5:
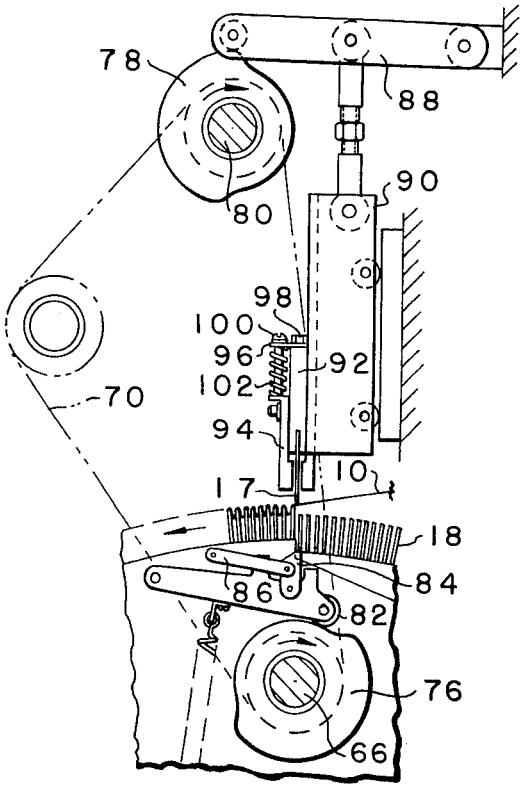

Looking now to FIGS. 5–7 the loop forming operation will be explained. In FIG. 5 the ratchet 58 and pawl 60 have been actuated to rotate the blade 18 to the position indicated. The cam 78 has pivoted the lever 88 to the extreme upward position to hold the blade 17 in its up position. Then as the cams 76 and 78 continue to rotate they assume the position shown in FIG. 6 wherein the upper blade 17 is lowered to bend the yarn downward over one of the blades 18 while the presser foot 94 engages the top of the previously formed yarn loop to prevent it from being pulled out as the blade 17 folds the yarn over the blade 18. Then as the cams 76 and 78 continue to rotate they assume the position shown in FIG. 7 wherein the blade 17 remains in the downward position while the arm 84 is moved upward by the cam 76 to slide the blade 18 upward to form the other half of the yarn loop between adjacent blades 18. Once the yarn loop is formed between adjacent blades 18 the cams 76 and 78, respectively, allow the blade 18 to retract and move the blade 17 upwardly. The blades 18 are once again indexed to the position shown in FIG. 5 and the cycle is repeated.

It should be noted that only half the yern loop is being formed at any one time, thereby reducing the frictional forces on the yarn between the blade 18 and the yarn. This results, necessarily, in a reduction in the amount of force necessary by the blades 17 and 18 to form the yarn loops.

Figure 9:
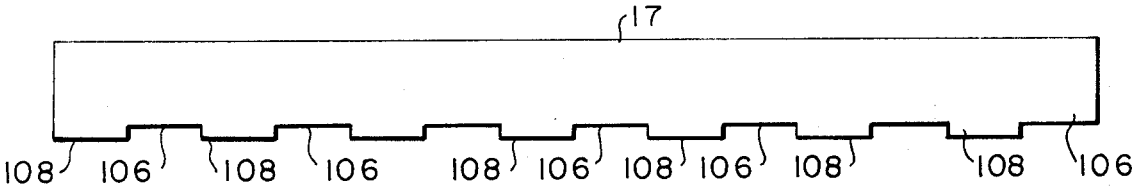
FIG. 9 is a front view of one of the upper notched blades.
Figure 10:
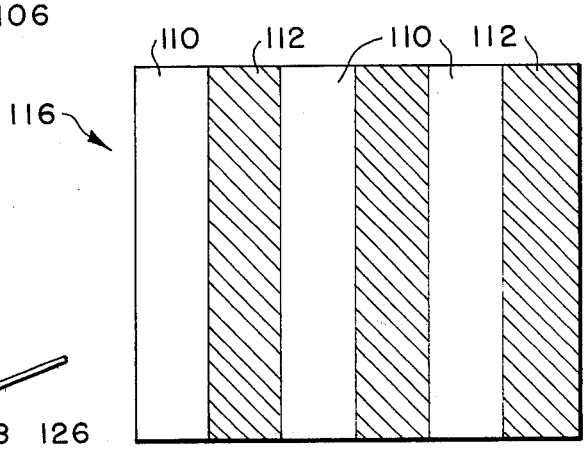
FIG. 10 is a schematic design view of a carpet which can be made with the notched blade.

FIG. 9 shows a modified version of the upper blade 17 which will provide a patterned effect in the carpet produced. Basically, this effect is obtained by providing notches 106 spaced from one another to provide high portions 108 therebetween so that certain selected yarns of yarn 10 are pushed further down between the lower blades 18 to provide high and low loops in the yarn attached to the backing sheet 20. In FIG. 9 the length of the notches is equivalent to the length of the high portion to provide equal width stripes 110 with a low pile and high pile stripes 112 as schematically represented in FIG. 10. Obviously, any width notch can be provided in the blade 17 to provide varying width stripe effects in the carpet 116.

Figure 12:
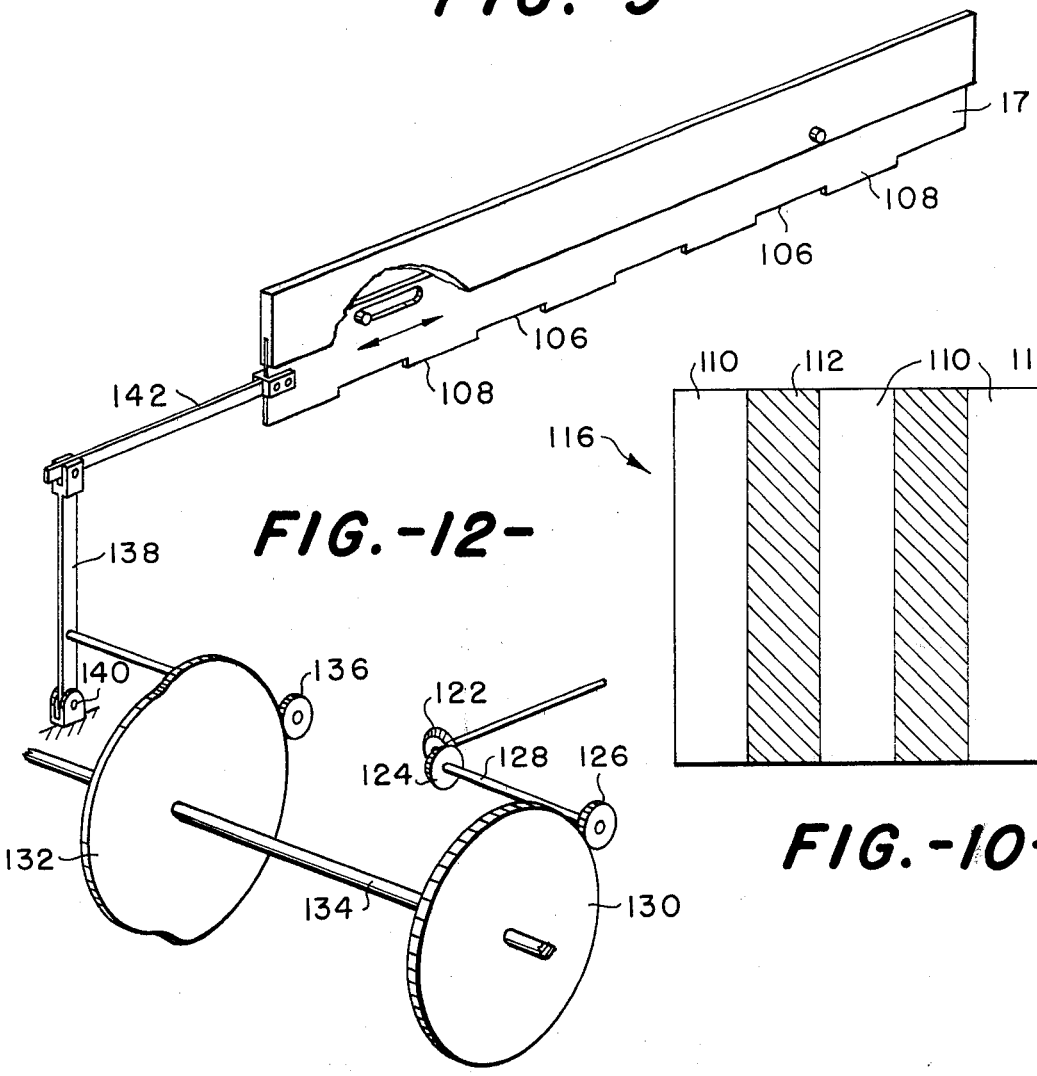
FIG. 12 is a schematic view of one means to shog the blade shown in FIG. 9.
Figure 11:
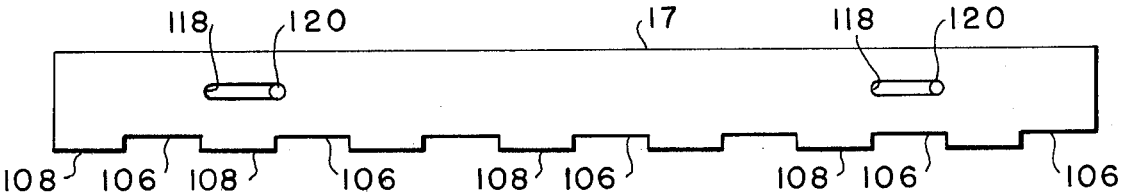
FIG. 11 is a modified view of the upper blade shown in FIG. 9.

Looking now to FIGS. 11 and 12 a further modification of the upper blade 17 is shown to allow shogging of the blade 17 to provide further variety of patterned effect. The blade 17 is provided with a plurality of slots 118 through which projects a pin member 120 mounted to the inside of the blade support 92. It is obvious that the pin member 120 supports the blade 17 in the holder 92 as well as allowing horizontal movement of the blade.

FIG. 12 shows schematically a system to periodically shog or move the blade 17 in a direction perpendicular to the yarn feed after the upper blade has cleared the previously formed loop. Basically, it comprises a bevel gear 122 mounted on the end of the machine drive shaft 66 and which engages another bevel gear 124 which drives the gear 126 through the shaft 128. Gear 126 in turn drives the gear 130 to rotate the cam 132 rigidly mounted on the shaft 134 which is also connected to the gear 130. As the cam 132 rotates the follower 136 follows the contour of the cam to pivot the lever arm 138 about a fixed point 140 to move the lever arm 142 inwardly and outwardly depending on the design of the cam 132.

In the preferred embodiments of the invention, as noted above, the notches 106 and the high portions 108 are of equal width so that the representative designs shown in FIGS. 13–17 have equal width high and low portions in any one row of loops but obviously such is not necessary and may differ and varied designs can be obtained by different width notches and high portions. Also the depth of the notches can be varied to vary the depth of the pattern in the finished carpet.

FIGS. 13–17 show various illustrative examples of patterns which can be obtained by changing the cams 132 and/or gearing to provide different motions and/or dwell periods of the blade 17. As in FIG. 10 the high portion of the pile in the carpet is represented by reference numeral 112 and the low portion of the pile by the reference numeral 110.

Figure 14:
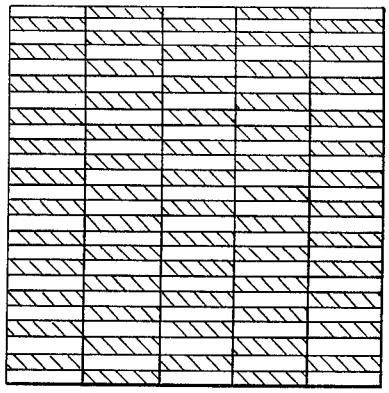
FIGS. 13–17 represent a few of the designs which can be made by shogging the upper blade members.
Figure 13:
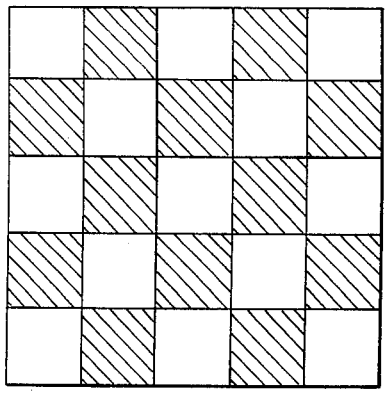

In FIGS. 13 and 14 the blade 17 is fully moved to the right and held there for a predetermined length of time to a predetermined number of rows of loops. In FIG. 13 the blade was held in the extreme right hand position quite a bit longer than in FIG. 14.

Figure 16:
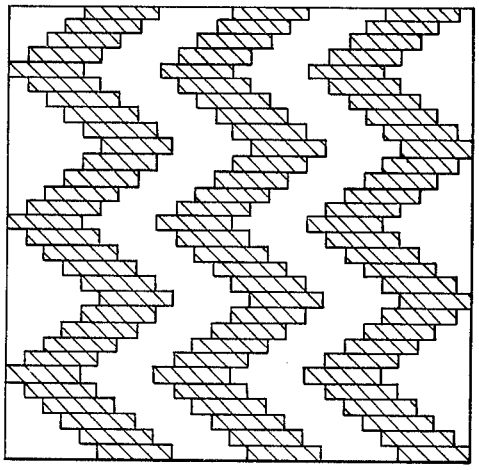
Figure 15:
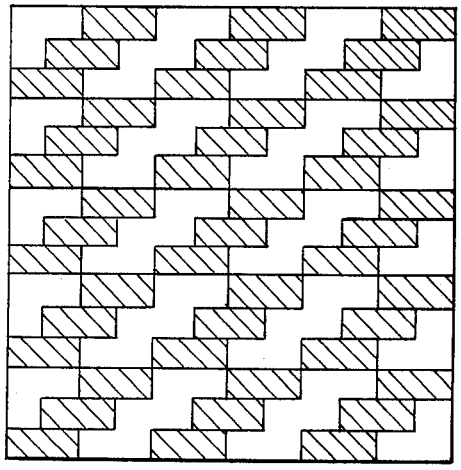
Figure 17:
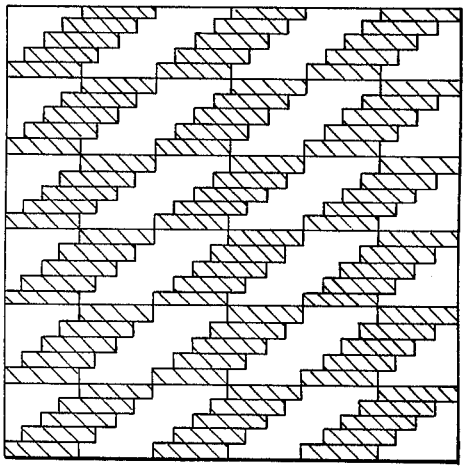

In FIG. 15 the blade was incrementally shogged in two steps and then returned to the starting position for a repeat. In FIG. 16 the blade was incrementally shogged five steps and then incrementally shogged back five steps and then the pattern repeats. FIG. 17 is similar to FIG. 15 except that the blade was stepped four times but held in each step for a shorter period of time to provide less rows of loops in each step.

The variations of patterns obtainable are infinite and depend on such variables as cam design, length of notches 106, length of slots 118 and the speed of shogging as determined by the main gear drive.

Although we have described specifically the preferred embodiments of our invention we contemplate that changes may be made without departing from the scope or spirit of our invention and we desire to be limited only by the claims.

That which is claimed is:

1. Apparatus to produce a bonded pile fabric comprising: a rotor, means to rotate said rotor, means slidably mounting a plurality of blades in said rotor, a second single blade member reciprocably mounted above said plurality of blades and operably associated therewith, means to supply yarn between said plurality of blades and said second blade member, said second blade member having notches in the bottom edge thereof to form high loops and low loops between two blades of said plurality of blades, means to move said second blade member downwardly at a predetermined time to bend the yarn over one blade of said plurality of blades, means to slide upwardly the blade of said plurality of blades next adjacent to the blade over which the yarn is bent to form a loop in said yarn, means to move said second blade member upwardly away from the formed loops, means to periodically move said second blade member in a direction parallel to the axis of said rotor as said second blade member moves upwardly, means to index said rotor to rotate said rotor a predetermined distance to place the blade members in loop forming position, means to supply an adhesive backed backing material into contact with said formed loop, means to set the bond between said adhesive and said loop and means to guide said backing material with loops bonded thereto away from said apparatus, said rotor including a means to maintain said blades of said plurality of blades in said loops until said rotor is indexed to a point where a formed loop is guided away from said apparatus and a means to align said plurality of blades to slide downwardly after the formed loop is guided away from said apparatus.

2. The apparatus of claim 1 wherein the means to slide the plurality of blades and said second blade member includes a cam.

3. The apparatus of claim 1 wherein a presser foot means is operably associated with said second blade member to hold in place the next adjacent previously formed loop.

4. The apparatus of claim 1 wherein said rotor includes a plurality of rings with a plurality of notches in the outer surface thereof, said blade members of said plurality of blade members being supported in said notches.

5. The structure of claim 1 wherein said means slidably mounting said plurality of blades includes a notches ring and a support ring, said means to allow said plurality of blades to slide downwardly includes a chord section cut out of said support ring.

* * * * *